US009540774B2

(12) United States Patent
Spuler et al.

(10) Patent No.: US 9,540,774 B2
(45) Date of Patent: Jan. 10, 2017

(54) EXPANSION JOINT BRIDGING DEVICE

(71) Applicant: Mageba S.A., Bulach (CH)

(72) Inventors: Thomas Spuler, Neerac (CH); Niculin Meng, Zurich (CH); Simon Hoffmann, Constance (CH)

(73) Assignee: Mageba S.A., Bulach (CH)

( * ) Notice: Subject to any disclaimer, the term of this patent is extended or adjusted under 35 U.S.C. 154(b) by 57 days.

(21) Appl. No.: 14/721,286

(22) Filed: May 26, 2015

(65) Prior Publication Data

US 2015/0259861 A1 Sep. 17, 2015

Related U.S. Application Data

(63) Continuation of application No. PCT/EP2013/003565, filed on Nov. 26, 2013.

(30) Foreign Application Priority Data

Nov. 27, 2012 (DE) ..... 10 2012 023 129

(51) Int. Cl.

| | |
|---|---|
| ***E01D 11/00*** | (2006.01) |
| ***E01C 11/02*** | (2006.01) |
| ***E01D 19/06*** | (2006.01) |
| ***E01C 11/00*** | (2006.01) |
| ***E01C 11/16*** | (2006.01) |

(52) U.S. Cl.

CPC ..... *E01C 11/02* (2013.01); *E01C 11/00* (2013.01); *E01C 11/16* (2013.01); *E01D 19/062* (2013.01)

(58) Field of Classification Search

CPC ..... E01C 11/00; E01C 11/02; E01C 11/16; E01D 19/062

USPC ..... 14/73.5

See application file for complete search history.

(56) References Cited

U.S. PATENT DOCUMENTS

| | | | |
|---|---|---|---|
| 5,887,308 | A | 3/1999 | Walter |
| 5,964,069 | A | 10/1999 | Schmidt |
| 2008/0148499 | A1 | 6/2008 | Bradford |

FOREIGN PATENT DOCUMENTS

| | | | |
|---|---|---|---|
| DE | 3212717 | C1 | 11/1983 |
| DE | 3514776 | C1 | 7/1986 |
| DE | 19705531 | A1 | 8/1998 |
| DE | 19705531 | C2 | 7/2001 |
| EP | 0090986 | A2 | 10/1983 |

(Continued)

OTHER PUBLICATIONS

International Search Report for International Application No. PCT/EP2013/003565 mailed Mar. 5, 2014.

*Primary Examiner* — Raymond W Addie
(74) *Attorney, Agent, or Firm* — Myers Wolin, LLC

(57) ABSTRACT

An expansion joint bridging device which bridges an expansion joint between two construction work parts of a traversable construction work. The expansion joint is spanned by at least two crossbeams which are supported in a load-bearing manner on both construction work parts, wherein at least one of the load-bearing supports allows a displacement movement. An overload safety device comprises two supporting profiles at a distance from one another and supported on the crossbeams, and a fill profile bridging the gap between the support profiles. If a threshold value for the force that would effect the two support profiles to approach one another is exceeded, a fixing device releases the positional stabilization such that the two support profiles can be moved towards one another by displacing the fill profile upwards out of the gap.

21 Claims, 5 Drawing Sheets

(56) References Cited

FOREIGN PATENT DOCUMENTS

| | | | |
|---|---|---|---|
| EP | 1355009 | A2 | 8/1998 |
| EP | 1355009 | B1 | 12/2011 |
| WO | 0198599 | A1 | 12/2001 |
| WO | 2008071386 | A1 | 6/2008 |

L
S
H

EXPANSION JOINT BRIDGING DEVICE

CROSS REFERENCE TO RELATED APPLICATIONS

This application is a continuation under 35 U.S.C. §120 of International Application PCT/EP2013/003565, filed Nov. 26, 2013, which claims priority to German Application 10 2012 023 129.6, filed Nov. 27, 2012, the contents of each of which are incorporated by reference herein.

FIELD OF THE INVENTION

The invention relates to an expansion-gap bridging device in the form of a multi-plate roadway expansion joint, which bridges over an expansion gap, which is disposed between two structural parts of a traffic-carrying structure and is spanned by at least two crossbeams. These are braced in load-bearing relationship on structure parts, wherein at least one of the load-bearing bracing points permits a displacement movement of the respective crossbeam relative to the structure part in question. Several chord plates disposed above the crossbeams and oriented at least substantially parallel to one another are braced on the crossbeams in such a way that they can be displaced relative to the crossbeams as well as relative to one another.

BACKGROUND

Bridges and comparable traffic-carrying structures are provided between abutments and superstructure and/or between subsections of the superstructure with expansion gaps, in order to permit damage-free thermal expansion or contraction of the superstructure. Depending on the size of the bridges in question, expansion gaps within the range of up to several meters are necessary. In order to permit vehicles to travel over the expansion gaps in question, expansion-gap bridging devices are provided.

In this context, the use of multi-plate roadway expansion joints is particularly well known, wherein two bridge parts (in this sense, the abutment is also a "bridge part") are joined to one another by at least two crossbeams spaced apart from one another, in such a way that the ends of bridge parts in question facing one another can undergo a relative movement toward and away from one another in the longitudinal direction of the crossbeams. Chord plates spaced apart from one another, capable of moving relative to one another and oriented substantially transversely relative to the longitudinal direction of the crossbeams, are braced on the crossbeams, such that their respective top side can be positioned substantially at the level of the roadway of the bridge or can form this, although embodiments are also known in which separate elements forming the traffic-carrying surface are disposed on the chord plates at their top side. If the ends of the bridge parts move toward one another because of thermal expansion in the longitudinal direction of the crossbeams, the spacing between the chord plates decreases. If the ends of the bridge parts move away from one another because of thermal contraction in the longitudinal direction, the spacing between the chord plates increases. Examples of pertinent prior art in this respect can be found in DE 19705531 C2, DE 3514776 C1 and DE 3212717 C1.

In regions threatened by earthquakes, the danger exists of abruptly occurring changes of position of the bridge parts relative to one another (especially in longitudinal direction of the crossbeams or with such a movement component). Under certain circumstances these changes can no longer be compensated by multi-plate roadway expansion joints, because they exceed the working range of the use for which they are intended. It is then conceivable that the bridge parts will move so much toward one another in longitudinal direction, beyond the normal thermal expansions, that the chord plates temporarily bear against one another in certain positions of the bridge parts, and further movement of the bridge parts toward one another results in internal stresses and possible damage to the chord plates or bridge parts. In such cases it is not enough to anticipate that the carrying capacity of the bridge for vehicular traffic is no longer assured after the earthquake; to the contrary, the damage to the bridge parts and/or the expansion-gap bridging device may be so pronounced that the bridge has to be completely rebuilt.

U.S. Pat. No. 5,887,308 A discloses an expansion-gap system for bridges that is designed not only to compensate for longitudinal expansions in travel direction—caused by normal fluctuations of the ambient temperature—but also to withstand seismographic forces occurring in transverse direction relative to the roadway. For this purpose the expansion-gap system comprises a plurality of chord plates spaced apart from one another and capable of displacement, braced on a plurality of crossbeams mounted at their ends in boxes. At one end the crossbeams are respectively movable within bearing boxes in transverse direction relative to the roadway of the bridge, so that forces or displacements occurring in this direction, for example due to an earthquake, lead to corresponding transverse displacements of the crossbeams. A disadvantage is that extremely large changes of the gap width of the expansion gaps occurring during earthquakes can no longer be compensated when the chord plates are already bearing against one another, thus resulting in destruction of the expansion-gap system or detachment thereof from the structure parts, whereby the bridge will no longer be able to carry traffic for the time being after an earthquake.

The foregoing also applies to the expansion-gap bridging device according to U.S. Pat. No. 5,964,069 A. Certainly the entire bridging device therein is raised at one end in order to forestall permanent damage thereto when seismic events cause the gap width of the expansion gaps to narrow beyond the point at which the chord plates bear against one another. Nevertheless, this also prevents the bridge from being able to carry traffic after the earthquake. And the repair work is associated with quite considerable expense, quite aside from the fact that, in the case of a permanent change of position of the structure parts relative to one another caused by the earthquake, even if complete reconstruction of the expansion-gap bridging device is not necessary, at least very expensive adaptation of the expansion-gap bridging device to the new tectonic conditions is needed.

The objective of US 2008/0148499 A1 and EP 1355009 B1 is to alleviate at least part of these disadvantages. Thus EP 1355009 B1 discloses a bridging device for joint gaps between bridge parts of the type mentioned in the introduction that if at all possible is still intended to be capable of carrying vehicular traffic even after an earthquake, albeit to a restricted extent and with considerably greater difficulty. For this purpose, the expansion-gap construction readily permits, within first limits, changes of position of the bridge parts adjoining the expansion gap relative to one another to occur during use for which they were intended. An additional safety device disposed on one of the bridge parts and on the expansion-gap construction is intended to permit position changes of the bridge parts toward one another beyond those limits without destroying the function of the bridging device or separating the expansion-gap construction from the bridge parts. The safety device comprises at least two elements, which are firmly joined to one another but which are separated if a defined limit load is exceeded and then can be moved toward one another in a well-defined way, for which purpose one of the two elements can be firmly disposed on one of the two bridge parts. Depending on the construction of the safety device, it is intended that additional position changes in the direction of the crossbeams and/or transverse movements of the bridge parts toward one another can be compensated. The safety device represents a predetermined breaking point, which necessitates extensive repair actions after the specified limit load has been exceeded in the direction transverse to the chord plates of the expansion-gap construction. Firstly the roadway expansion joint must be restored to its original position. Then certain elements of the expansion-gap construction, including the broken safety device, must be replaced and connections adjoining it must be rehabilitated.

Nevertheless, at least some of the disadvantages depicted hereinabove in connection with U.S. Pat. No. 5,964,069 A also exist in the bridging device according to EP 1355009 B1.

SUMMARY

The object of the invention is therefore to provide an improved, functionally optimized expansion-gap bridging device of the type mentioned in the introduction that optimally withstands even changes of position of two bridged-over bridge parts caused by an earthquake and offers the best prerequisites for traffic-carrying capacity after an earthquake or greatly simplified repair with the smallest possible expense.

The object is achieved by the expansion-gap bridging device specified in the claims. Accordingly, the inventive expansion-gap bridging device, in functional combination with the other construction features, is characterized in particular in that there is provided, between two of the chord plates that can be displaced relative to the two structure parts, to the crossbeams as well as to one another, an overload-safety device comprising two bracing profiles spaced apart from one another and braced on the crossbeams as well as one filler profile bridging the gap between the bracing profiles. For this purpose, a fixation device that clamps the position of the two bracing profiles relative to one another acts, when the force acting in the sense of approach of the two bracing profiles toward one another exceeds a threshold value, to release the position clamp in such a way that the two bracing profiles can be moved toward one another while forcing the filler profile upward out of the gap.

The overload-safety device may be disposed at arbitrary positions of the bridging device, i.e. between two arbitrary chord plates, namely even more or less in the middle of the bridging device, especially when "only" one overload-safety device is provided. This extremely flexible ability of the overload-safety device to be disposed within the expansion-gap bridging device makes a contribution, compared with the known arrangement at the periphery of a bridge part or structure part, to improving the safety relative to shock forces occurring during earthquakes. In the case of overload-safety devices disposed at the periphery of a bridge part, these forces are transmitted directly thereto and may lead to their destruction or damage. In contrast, an "internal" arrangement of the overload-safety devices between two of the chord plates has the advantage that seismic shock forces are first transmitted to the chord plates, compressing the chord-plate assemblies together. Only when all chord plates disposed (in the shock direction) upstream from the overload-safety device are bearing against one another are forces transmitted to the bracing profiles of the overload-safety device. Thus the chord plates fulfill a buffer function relative to occurring shock forces, by the fact that these forces first act in longitudinal direction on the chord plates, and that the overload-safety device is tripped only in the case of an extremely large force, caused, for example, by an earthquake. The fact that the overload-safety device is embedded within the chord plates of the bridging device actually also favors—because of the more or less pronounced symmetry of the load situation made possible hereby—tripping of the overload-safety device exclusively in the design case anticipated for this, resulting in the greatest advantage for the traffic-carrying ability of the bridging device after tectonic shaking below the design situation. Even for the function of the overload-safety device itself, its "internal" arrangement between two of the chord plates is greatly beneficial, since the filler profile can be raised uniformly and without tilting sideways from the gap between the bracing profiles, because the arrangement in the middle of the expansion-gap bridging device permits particularly symmetric force action on the bracing profiles.

The overload-safety device comprises two outer bracing profiles mounted on the crossbeams as well as one filler profile, which is disposed between the bracing profiles and closes the openings between the bracing profiles on the roadway side. In the non-tripped condition of the overload-safety device, the top side of the filler profile (together with associated gaskets if applicable) should be disposed at the same height as the top side of the chord plates and the top sides of the bracing profiles (respectively together with associated gaskets if necessary), in order to assure a rolling surface that is as even as possible for the vehicles traveling over the expansion-gap bridging device. The upward expulsion of the filler profile from the gap existing between the bracing profiles—which occurs upon tripping of the overload-safety device—can take place constructively in various ways. One possibility in particular is that the filler profile as a whole will be forced upward out of the gap without any change of its geometry. Nevertheless, another possibility is that the filler profile changes its geometry upon being forced upward from the gap that exists between the bracing profiles, for example by the fact that a filler profile consisting of several segments joined to one another in hinged relationship is folded upward.

A fixation device ensures (in "normal" operating condition) that the bracing profiles are clamped in position relative to one another (in longitudinal direction of the crossbeams). The strength of this position clamp defines, for forces acting on the bracing profiles, a threshold value, above which the position clamp applied by the fixation device is released and the bracing profiles are able to move in longitudinal direction toward one another. During such a movement, the filler profile is forced upward out of the gap between the two bracing profiles (see hereinabove), whereby the bracing profiles, which for their part have a multi-plate-like function, are able to move correspondingly closer to one another and thus the entire extent of the partial structure of the expansion-gap bridging device resting on the crossbeams can be further shortened in longitudinal direction without destruction of the device by excessively high internal stresses. As already indicated hereinabove, a smaller and more precise level can be selected for the said threshold value in the inventive arrangement of the overload-safety device compared with an arrangement at the periphery of a bridge part, by virtue of the buffer function of the chord plates and the possible symmetry of the load situation, whereby material, weight and costs can be saved and the function of the overload-safety device can be improved.

If a change of position of the structure parts remains permanently after a seismic event, it may be possible to correct the expansion-gap bridging device with minimum expense solely by installation of a filler profile adapted to the new situation, so that the bridging device is functionally reliable not only temporarily but instead permanently.

In other respects, the present invention makes it possible to integrate several (functionally equivalent) overload-safety devices in the expansion-gap bridging device—especially distributed more or less regularly over the extent thereof. This opens further-reaching options for adaptation—by evaluation of the tectonic situation—of the safety device(s) to the seismic events to be anticipated. It is further possible to dispose two or more overload-safety devices directly next to one another between two chord plates adjacent to one another, in which case a middle bracing profile common to both overload-safety devices may be provided if necessary. In this way transverse and vertical offsets between the bridge parts can be better compensated, at least partly, if the position clamp is released, because the offsets are distributed over several overload-safety devices.

The two bracing profiles are typically braced such that they can be displaced by sliding along the crossbeams, although this is not an absolute requirement. Specifically, it is also conceivable that one of the bracing profiles is firmly joined to one or more (or even all) crossbeams. Another possibility is even that both bracing profiles are firmly joined alternately to crossbeams, in such a way that both bracing profiles are not fixed on one crossbeam.

In a first improvement of the invention, it is provided that the filler profile is part of the fixation device. Hereby material that would otherwise be used for a separate component functioning as the position clamp can be saved. In this case the bracing profiles are firmly joined to the filler profile on both sides. The filler profile acts as a spacer between the bracing profiles. An effective position clamp with distribution of forces to both sides of the fixation device can be achieved, and a contribution can be made to forcing the filler profile uniformly out of the gap between the bracing profiles. For this purpose it is advantageous when the filler profile is joined to the bracing profiles by means of a fastening element with predetermined breaking load, for example in the form of a bolted or riveted joint or a welded seam. Such joints can be designed particularly inexpensively and reliably.

In a further embodiment it is provided that parts of the bracing profiles are used as bearing for the filler profile, wherein the filler profile rests with peripheral regions on bracing regions of the bracing profiles. This arrangement makes it possible to facilitate expulsion of the filler profile if the position clamp is released, i.e. if the overload-safety device is tripped, and to save material that would otherwise be needed for an additional bearing. Furthermore, for the last-mentioned embodiment, it is advantageously possible to provide a sealing gasket for the peripheral regions of the filler profile on the bracing regions of the bracing profiles. Such a sealing gasket can consist, for example of a rubber seal, by which ingress of liquid and dirt into the intermediate space between the bracing profiles can be prevented particularly effectively, thus specifically benefiting the protection of the crossbeams and maintenance of the ability of the chord plates to slide thereon.

In a further embodiment, it is provided that sliding chamfers are formed on the filler profile and/or the bracing profiles, in order to favor raising of the filler profile when the bracing profiles move toward one another. These sliding chamfers represent a particularly simple and effective means for achieving controlled upward movement of the filler profile due to longitudinal movement of the bracing profiles. In this case the arrangement of corresponding sliding chamfers in the region of the gasket of the filler profile on the bracing profiles and on the filler profile is particularly advantageous, because a controlled movement of the filler profile can be achieved immediately after release of the position clamp. In addition, it is practical to use the free space within the gap between the bracing profiles for a further sliding profile, which is disposed on one part of the filler profile and can extend for a length falling within the range of the height of the bracing profiles. Together with correspondingly shaped mating pieces on the bracing profiles, a controlled sliding movement of the filler profile over almost the entire range of movement of the filler profile can be achieved thereby.

In a further advantageous embodiment of the invention, the filler profile (in "normal" operating condition of the bridging device) is braced on the crossbeams. Especially because the filler profile typically has a much greater extent than the chord plates in longitudinal direction of the crossbeams, such an intermediate bearing is practical for decreasing any bowing of the elongated upper part of the filler profile disposed in the region of the roadway.

In one constructive configuration of this embodiment, the filler profile is joined to the bracing profiles in the way explained in the foregoing via fastening elements with predetermined breaking load, in which case the fasteners with predetermined breaking load establish clamping of the filler profile against the crossbeams. In this way constant contact between the filler profile and the crossbeams can be ensured without much more structural complexity, and so the safety against tilting can be increased. For this purpose it is preferably provided that the filler profile rest with a sliding bearing on the crossbeam. By virtue of the clamping explained in the foregoing, it can be durably ensured, even in the presence of wear of the sliding bearing, that this always rests on the crossbeams. In a further constructive configuration of this embodiment, frames that embrace the crossbeams and are equipped with a sliding spring in order to clamp the filler profile against the crossbeams as well as with at least one predetermined breaking point, for example in the form of a bolted joint, are assigned to the filler profile. Preferably the sliding spring is joined at one end to respectively a bottom part of a frame, while the other end of the sliding spring is in contact in sliding relationship with the underside of the crossbeam. Moreover, the filler profile preferably rests with a sliding bearing on the crossbeam. Hereby constant contact between the filler profile and the crossbeams can be achieved without generating high internal stresses within the filler profile.

Furthermore, if an overload-safety device is provided, it is advantageous for this to be disposed in the middle of the multi-plate roadway expansion joint. For an even total number of chord plates, ideally equally many chord plates are then disposed on both sides of the bracing profiles. If the total number of chord plates is uneven, accordingly one chord plate more is disposed on one side of the bracing profiles than on the other side. In this embodiment, the overload-safety device acts as a symmetric separator for the chord-plate assemblies. In this way a quasi-two-piece expansion-gap bridging device with an at least approximately equal number of chord plates on both sides can be created by the overload-safety device, whereby the distribution of the movements to the individual chord plates and the useful life of the expansion-gap bridging device can be improved as a whole.

As explained hereinabove, the overload-safety device resting on the crossbeams with the bracing profiles and preferably also with the filler profile is indeed typically movable in the longitudinal direction of the crossbeams but, because its dead weight is greater than that of a chord plate, it reacts with greater inertia and correspondingly higher friction force than do the individual chord plates. Thereby a contribution is made to ensuring that the chord plates are subjected to uniform stresses and strains on both sides of the bracing profiles. As a rule, one of the bridge parts can be displaced in longitudinal direction of the crossbeams while the other is mounted in fixed position in longitudinal direction of the crossbeams. In the case of a relative movement of the bridge parts toward one another, for example in the form of thermally induced length expansion of at least one bridge part or of a change in position of a bridge part without tripping the overload-safety device, the overload-safety device is able to remain in its position relative to the crossbeam, while the crossbeams are able to move into and out of crossbeam boxes. In the ideal case, all chord plates are activated and moved equally, by the fact that the relative movement on both sides of the overload-safety device is distributed almost equally to all chord plates.

The provision of an anti-lift safeguard between the bracing profiles and the crossbeams can make a further contribution to the functional safety of the overload-safety device, by the fact that the security of seating of the bracing profiles in the crossbeams is improved. An undesired detachment of the bracing profiles in upward direction can be prevented thereby. Besides the reduction of the risk of detachment of the bracing profiles from the crossbeams, tilting of the bracing profiles can also be prevented effectively. Flawless seating of the bracing profiles on the crossbeams facilitates the intended movement of the filler profile in the emergency situation and thus increases the functional safety of the overload-safety device. In a constructive configuration of such an anti-lift safeguard, it is advantageous to provide respectively a frame (with small spacing around the crossbeam in question), which can be joined on its top side to the bracing profile by a bolted joint, which functions as a predetermined breaking point, while (top) slide blocks and/or (bottom) sliding-spring blocks are preferably disposed between the frame and the respective crossbeam.

In this embodiment, the protection of the bracing profiles against tilting can be even further increased by providing, between the frames of the two bracing profiles, spacer elements that are disposed underneath the crossbeams and are joined to the frames by means of fastening elements with predetermined breaking load. In this way the two bracing profiles are coupled with one another, their seating on the crossbeams is further stiffened and their spacing relative to one another is clamped once again.

Furthermore, it is advantageous to provide respectively at least one sliding spring within the frames clamping the bracing profiles against the crossbeams. One end of the said sliding springs can be joined particularly simply to respectively the lower side of a frame, while the other end of the sliding springs is in contact in sliding relationship with the underside of the crossbeam. An identical number of sliding bearings should be disposed opposite the at least one sliding spring, between the upper inner side of the frame and the top side of the crossbeam. In this arrangement, the spring forces of the sliding springs advantageously act in the same direction as the inertial forces of the bracing profiles.

Thereby the bias tension of the sliding springs and the inertia of the overload-safety device with respect to movements along the crossbeams can be further increased, as can the safety against tilting of the bracing profiles on the crossbeams. These effects can be further reinforced by the use of several sliding springs per frame and bracing profile or by larger sliding springs, although in this case the frame should advantageously have an extent in longitudinal direction L of the crossbeam that is sufficient to accommodate the sliding springs completely.

Furthermore, it is advantageous when the bracing profiles and/or the filler profile have a traffic-carrying surface on their top side on the roadway side. By virtue of this configuration, the top side of the bracing profiles can be used directly as the roadway pavement for the bridge, without the need to apply a further layer or gasket, whereby material, weight and costs can be saved.

In an improvement of the inventive subject matter, it is provided that the bracing profiles are sealed against adjacent chord plates by means of deformable sealing strips, whereby moisture and dirt are effectively prevented from ingress at this point and from reaching the crossbeams, thus specifically benefiting protection of the crossbeams and maintenance of the ability of the chord plates to slide thereon.

It is also advantageous (especially in the sense of the symmetry of the load conditions already discussed hereinabove) when both ends of the crossbeams are braced in load-bearing and displaceable relationship on the structure parts. For this purpose, preferably the crossbeams project at both ends into crossbeam boxes.

The special aspects of the expansion-gap bridging device explained in the foregoing, just as the preferred improvements explained further on, can also be applied analogously to expansion joint bridging devices designed in view of the intended use for a smaller working range (narrower gap width), so that, in addition to the designated overload-safety device, they have only one single chord plate or possibly not even one true chord plate. In this case, either a single true chord plate is disposed at one end or else no true chord plate is disposed at either end in addition to the overload-safety device. The decisive point, however, is that the overload-safety device acts as a "quasi-chord plate", by the fact that it can move as a whole relative to both structure parts.

In other words: The expansion-gap bridging device in some embodiments differ from those of other embodiments by the fact that only one single chord plate is provided instead of several, while other embodiments are completely devoid of chord plates. Accordingly, the expansion gap is bridged either by the one chord plate and the overload-safety device or by only the latter, which in both cases is not firmly joined to any structure part. As an example, such expansion-gap bridging devices can be used advantageously where thermal expansions or contractions are of low relevance but the danger of abruptly occurring changes of position of the structure parts relative to one another is of high relevance.

BRIEF DESCRIPTION OF THE DRAWINGS

An exemplary embodiment of the invention is explained in more detail hereinafter on the basis of the drawing, wherein.

DETAILED DESCRIPTION OF THE PREFERRED EMBODIMENTS

Figure 1:
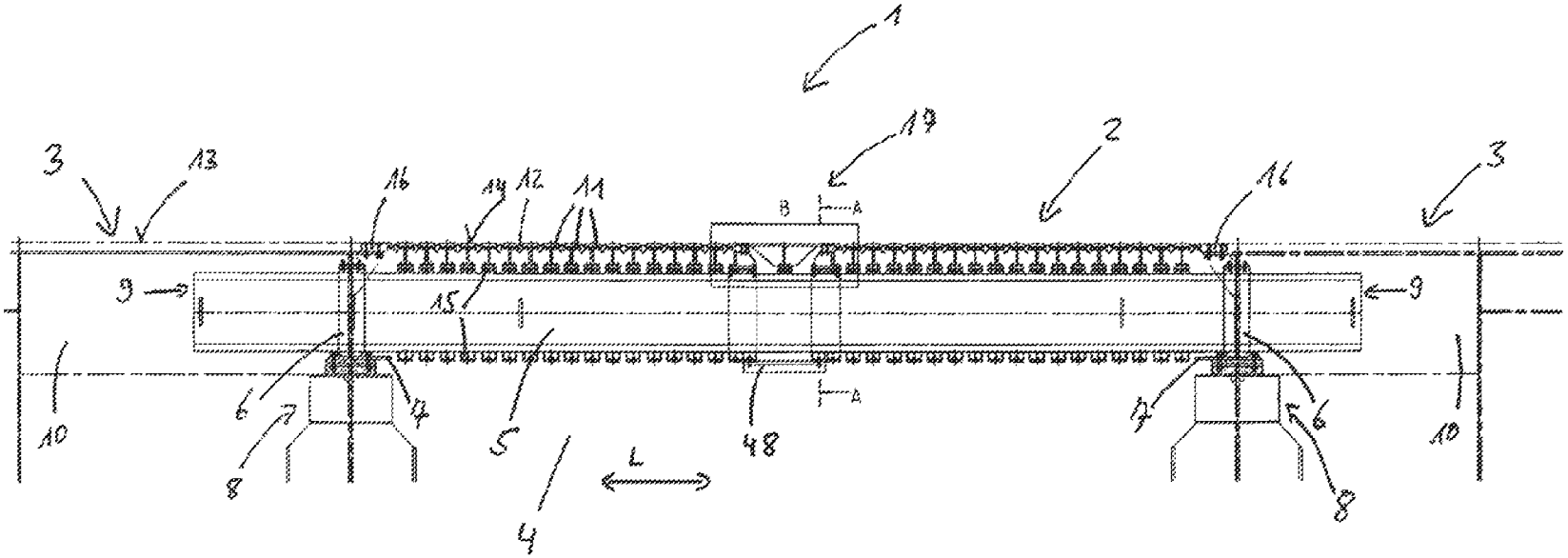
FIG. 1 shows a section parallel to the direction of the crossbeams through an expansion-gap bridging system constructed according to the invention.

FIG. 1 shows the practical example of an inventive expansion-gap bridging device 1 with a multi-plate roadway expansion joint 2, which is disposed between two bridge parts 3 for bridging over an expansion gap 4.

Several crossbeams 5, of which one is shown in FIG. 1, bridge over expansion gap 4 and are respectively mounted in two crossbeam bearings 6, which are fastened on two columns 8 of bridge parts 3 such that they can slide in longitudinal direction L. The two crossbeam ends 9 project into crossbeam boxes 10 of bridge parts 3.

Several chord plates 11 are braced on crossbeams 5. Chord plates 11 disposed parallel to one another are mounted on crossbeams 5 such that they can slide in longitudinal direction L. Between two chord plates 11 and joined thereto there is respectively disposed an elastic sealing strip 12 for protection, especially from moisture and dirt, of expansion-gap bridging device 1 underneath roadway plane 13, on which a roadway pavement suitable for vehicular traffic is preferably disposed in the sense of a traffic-carrying surface. The upper sides 14 of the chord plates coincide in height with roadway plane 13. Sliding chord-plate bearings 15 embrace the crosspieces in the manner of frames, wherein slide blocks are disposed respectively at the top between the frames of chord-plate bearing 15 and crossbeam 5 and respectively at the bottom between the frames of chord-plate bearing 15 and crossbeam 5. Chord plates 11 can be joined to one another (in the sense of spacing control) via mechanical spacing regulators, not illustrated, by which the displacement behavior of chord plates 11 relative to one another can be controlled in the presence of a force acting in longitudinal direction L. The movement of the respective left and right outermost chord plates 11 is limited at one end in longitudinal direction L by the peripheral profiles (projections 16) of bridge parts 3 as well as by spacers 7 (which cooperate as stops with the lower portions of the frames of chord-plate bearings 15).

To this extent, the expansion-gap bridging device relies on the sufficiently known prior art, and so further explanations are not needed either with respect to the construction or with respect to the function according to the intended use (compensation of thermal expansions or contractions of bridge parts 3 by variation of the spacings between chord plates 11 mounted displaceably on the crossbeams) in the design or working range.

An overload-safety device 17 is disposed between the total of 16 chord plates 11 on the left side and 17 chord plates 11 on the right side, and the openings between overload-safety device 17 and chord plates 11 adjoining it are closed by sealing strips 12.

Figures 2, 3:
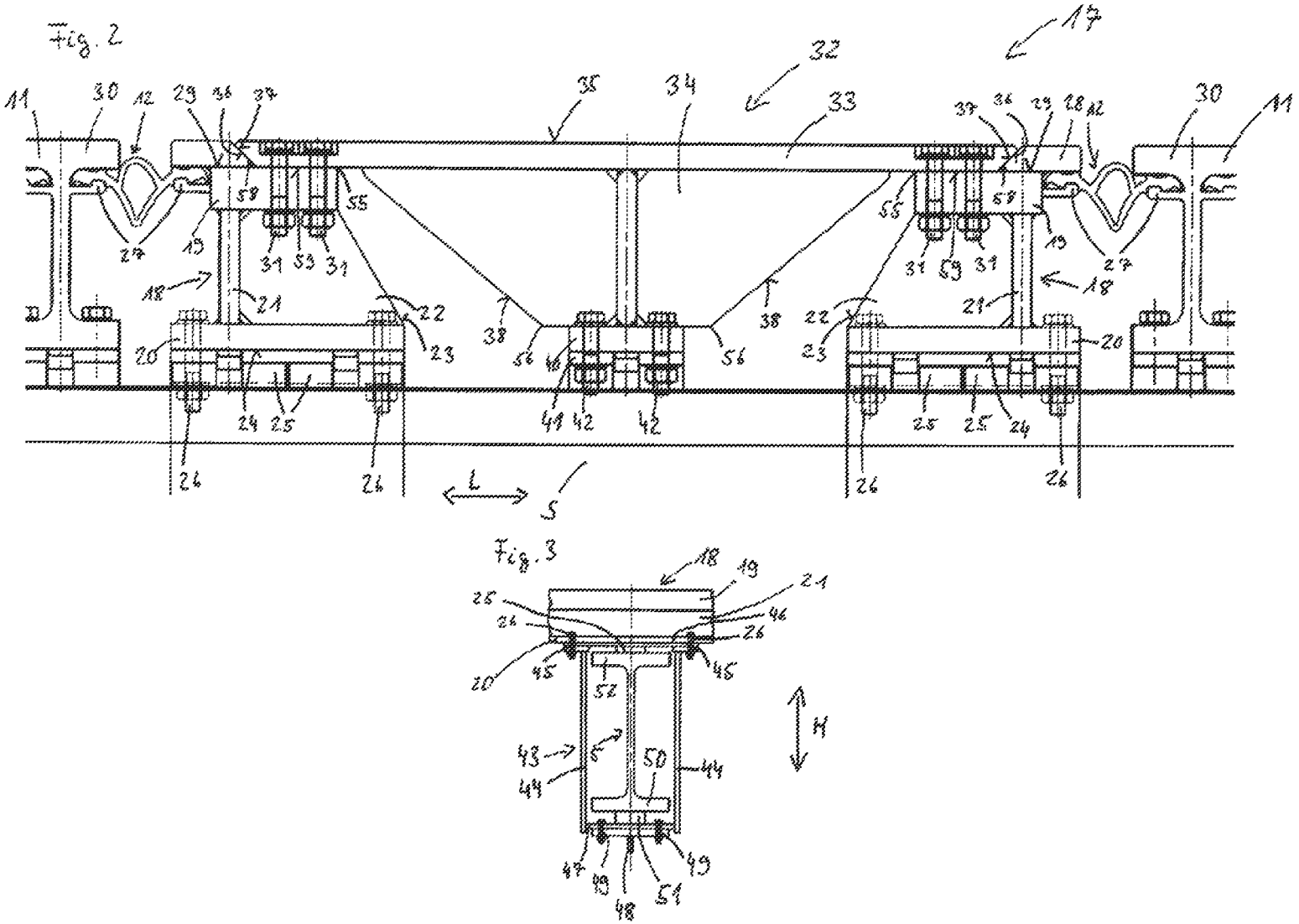
FIG. 2 shows an enlarged diagram of the overload-safety device and of the chord plates adjoining it according to detail B of FIG. 1.
FIG. 3 shows a cross-sectional view of the crossbeam and of the bracing-profile bearing according to section A-A through the overload-safety device of FIG. 1.

From enlarged detail B of FIG. 1 illustrated in FIG. 2, it can be seen particularly well that overload-safety device 17—displaceable in longitudinal direction L—has two bracing profiles 18 spaced apart from one another in longitudinal direction L and one filler profile 32 disposed between these and bridging over gap S between the two bracing profiles 18. In the normal operating situation, a fixation device acts to clamp the position of these parts relative to one another. The two bracing profiles 18, in a certain static resemblance to chord plates 11, respectively comprise a profile head 19, a profile foot 20 and a profile web 21 welded together with both, while additional stiffening elements 22 welded to the said three parts of the bracing profiles are provided with respectively an obliquely oriented stiffening side face 23. Bracing-profile bearings, which are joined via a pair of first bolted joints 26 to profile feet 20 and in particular comprise respectively two slide blocks 25 capable of sliding in longitudinal direction L of crossbeam 5, are joined to each bracing profile 18 (described hereinafter) at the respective profile-foot underside 24.

Profile heads 19 have hooks 27 extending in the direction of the adjacent chord plates 11. Guide elements 28 extending in the same direction are firmly joined to profile-head top sides 29 of profile heads 19 (which are substantially rectangular). Sealing strips 12 are firmly clamped at their peripheries in corresponding hollow spaces between hooks 27 and guide elements 28. All chord plates 11 have clamping devices 30 and hooks 27 similar to upper guide elements 28, whereby sealing strips 12 can be clamped both between two chord plates 11 and between chord plates 11 and bracing profiles 18.

Filler profile 32 has a plate 33 as well as a base 34 joined thereto. Outer left and right peripheral zones 59 of plate 33 of filler profile 32 rest on profile-head top sides 29 of profile heads 19 forming the bracing areas, while bracing profiles 18 are sealed from plate 33 of filler profile 32 by means of sealing gaskets 58. Profile heads 19 of bracing profiles 18 are fastened to filler profile 32 by a pair of second bolted joints 31, which constitute a component of the upper of two parts of the fixation device and are constructed as bolted joints with predetermined breaking load. Plate top side 35 of plate 33 is oriented at the same height as roadway level 13. Obliquely oriented plate side faces 36 of plate 33 bear against corresponding oblique guides 37 of guide elements 28. Base 34 of filler profile 32 comprises a web, a filler-profile foot 40 and stiffeners welded to these parts as well as to plate 33, wherein the latter have obliquely oriented base sides 38 converging in downward direction. A filler-profile bearing 41, which rests without clearance on crossbeam 5 but can slide along it in longitudinal direction L and is identical to slide blocks 25, bears against filler-profile foot 40. Second bolted joints 31 are tightened sufficiently that filler profile 32 is clamped by means of filler profile bearing 41 against crossbeams 5. Filler-profile bearing 41 is respectively joined firmly to filler-profile foot 40 of base 34 by a pair of third bolted joints 42.

FIG. 3 shows, in a sectional diagram according to section A-A of FIG. 1, especially the bracing-profile bearing, which in its basic structure is similar to partly visible chord-plate bearings 15. Profile foot 20 of bracing profile 18 is firmly joined to a frame 43, which embraces crossbeam 5 and in the manner of an anti-lift device prevents bracing profile 18 from undesired movement upward in vertical direction H. Frame 43 has two elongated side parts 44 as well as flanges 45, which are firmly joined thereto and are also firmly joined to profile foot 20 via first bolted joints 26. At the top, frame 43 is closed by bearing plate 46 disposed between flanges 45 and profile foot 20. At the bottom, the two associated slide blocks 25, which rest on upper crossbeam flange 52 such that they can slide on it, are disposed on bearing plate 46. Side parts 44 are joined firmly to bottom part 47 in the region of their lower ends. A spacer element 48 of T-shaped cross section, which is oriented underneath crossbeam 5 and forms the lower of the two parts of the fixation device, is joined to frames 43 associated with the two bracing profiles 18, by the fact that it is fastened respectively to bottom part 47 of frame 43 via a pair of fourth bolted joints 49. These fourth bolted joints represent bolted joints with predetermined breaking load. A spring bearing having the form of two sliding springs 51 spaced apart in longitudinal direction L and capable of sliding resiliently in vertical direction H is disposed between bottom part 47 and lower crossbeam flange 50.

Figure 4:
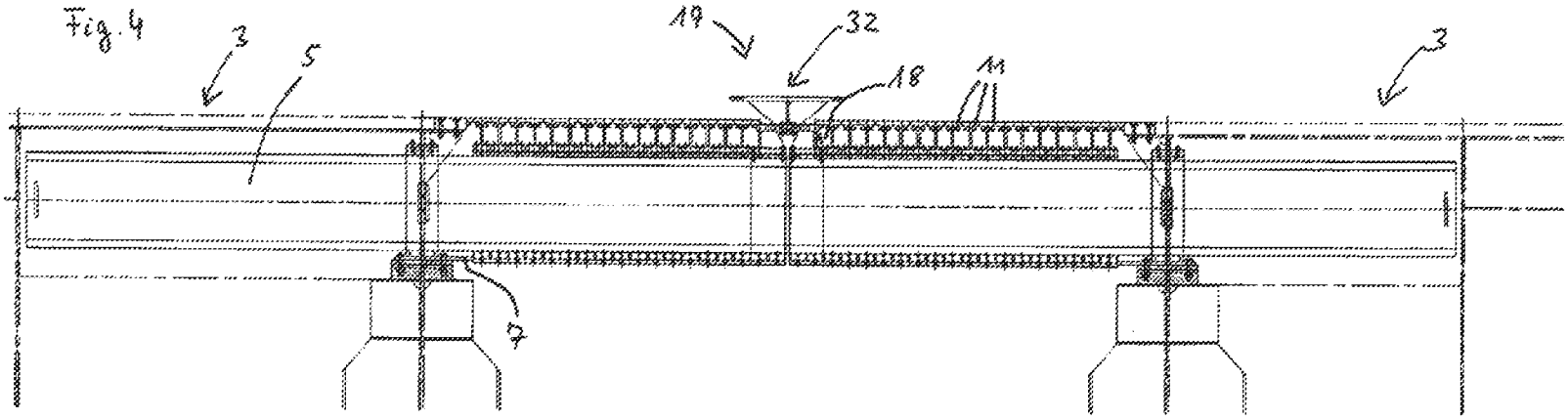
FIG. 4 shows a perspective section corresponding to FIG. 1 through the expansion-gap bridging device of FIG. 1 with released overload-protection device in planned almost minimum spacing of the bracing profiles relative to one another.

The function of expansion-gap bridging device 1 in the case that a movement of the two bridge parts 3 toward one another exceeds the normal design operation or working range can be described as follows:

If, because of an earthquake or other seismic event, for example, the two bridge parts 3 move toward one another in longitudinal direction of the crossbeams by an amount greater than would correspond to the design minimum spacing—defined by which by definition occurs when chord plates 11 are bearing against another against bracing profiles 19 of overload-safety device 17—overload-safety device 17 comes into play for more extensive compensation of the change of position, specifically until bracing profiles 18 approach one another as closely as possible, as illustrated in FIG. 4.

Via chord plates 11, which are bearing against one another in the form of a block, displacement forces acting in mutually opposite directions are transmitted to bracing profiles 18 themselves by bridge parts 3 via bracing profiles 18 of chord plates 11 adjacent to overload-safety device 17. The displacement forces are guided into the upper and lower part of the fixation device, which at first defines the spacing of bracing profiles 18 relative to one another. If a specified threshold value is exceeded, second bolted joints 31 (associated with plate 33 of the filler profile) and fourth bolted joints 49 (associated with spacing element 48), which represent joining elements of the fixation device with predetermined breaking load, are sheared. Hereby the position clamp of bracing profiles 18 is released and these are able to move toward one another. If bracing profiles 18 move toward one another, plate 33 with its obliquely oriented plate side faces 36 slides along oblique guides 37 of guide elements 28, and filler profile 32 moves upward in vertical direction H.

When bracing profiles 18 have moved so far toward one another that obliquely oriented base sides 38 are bearing against upper head edges 55, facing one another, of profile heads 19, obliquely oriented base sides 38 are able to slide along head edges 55 and move filler profile 32 further upward in vertical direction H. This sliding movement is possible until base edges 56 disposed at the ends of base sides 38 have reached the height of head edges 55. A slight further approach of the two bracing profiles 18 accompanied by upward movement of filler profile 32 is still possible even then, by the fact that filler profile bearing 41 slides on stiffening side faces 23. This movement is possible as long as the sides of profile feet 20 and slide blocks 25 facing one another are bearing against one another, since in this position of profile-foot 40 space exists between profile heads 19 of the two bracing profiles 18. The minimum expansion of expansion-gap bridging device 1 is reached in this position of bracing profiles 18.

Figure 5:
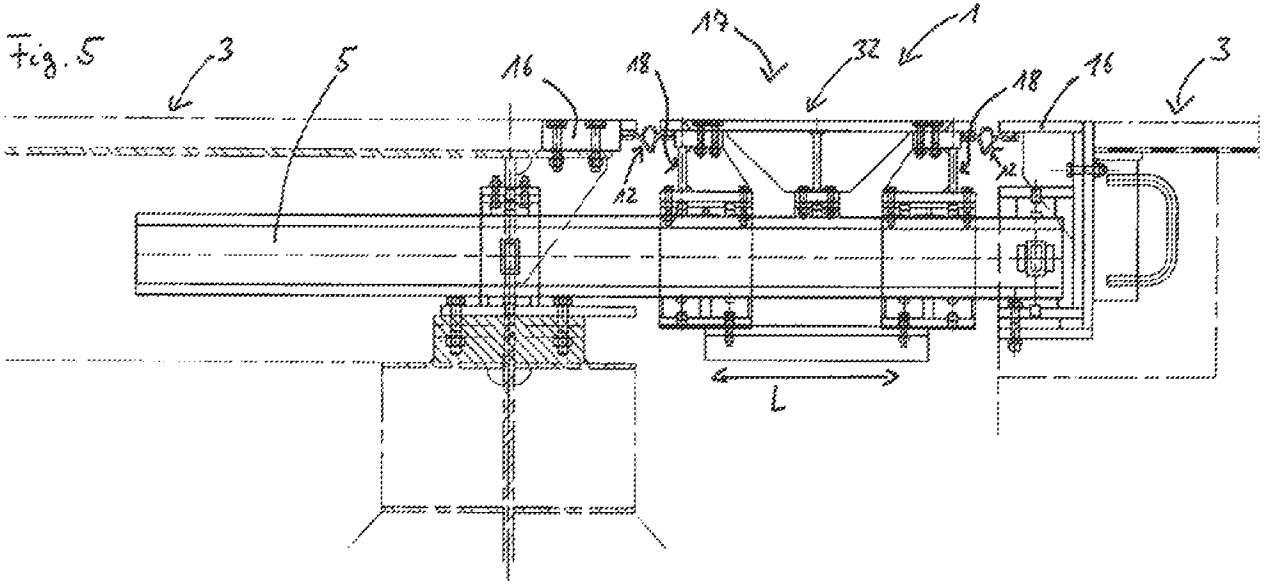
FIG. 5 shows a section parallel to the direction of the crossbeams through an expansion-gap bridging device constructed according to the invention without chord plates.
Figure 6:
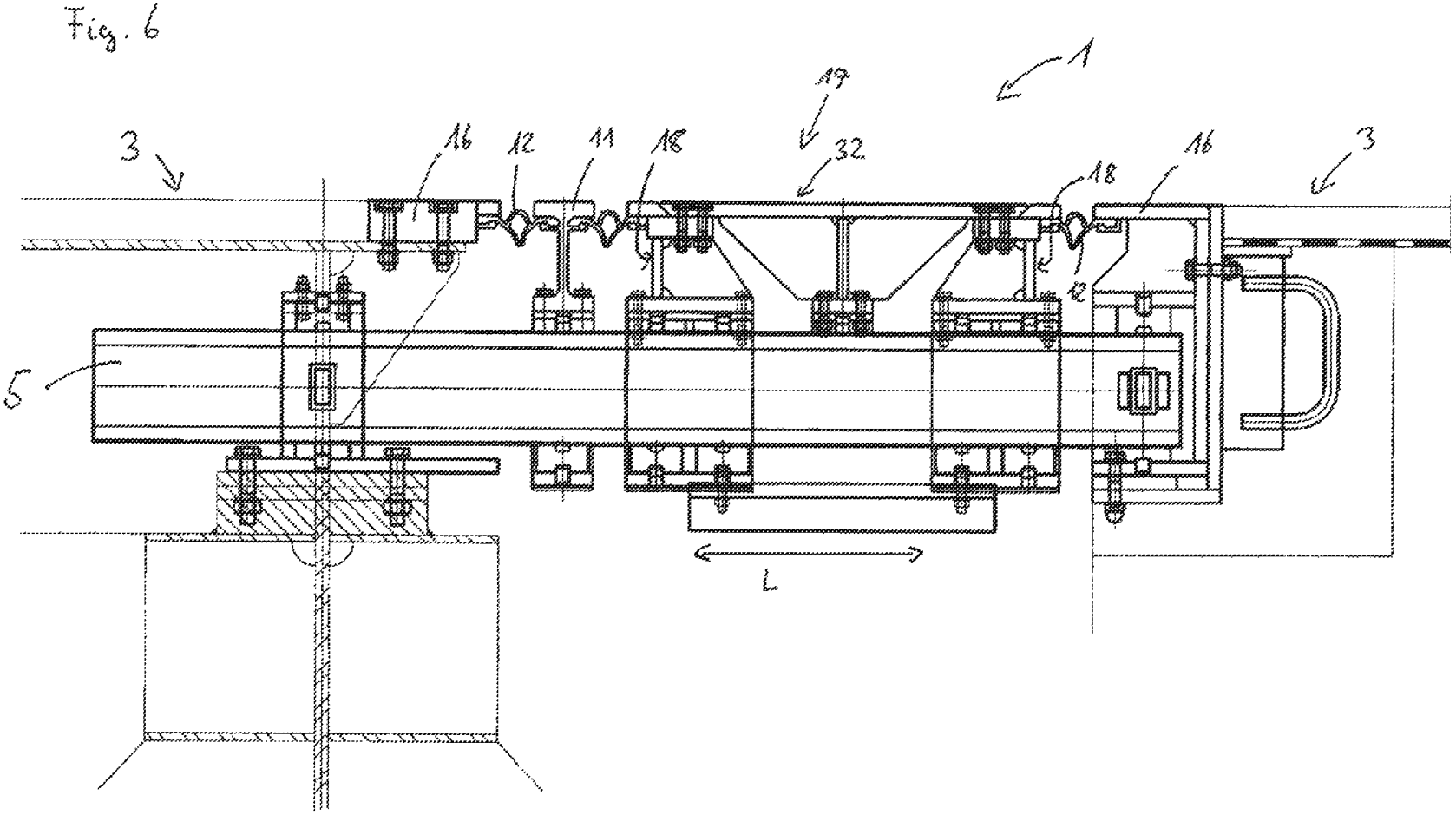
FIG. 6 shows a section parallel to the direction of the crossbeams through an expansion-gap bridging device constructed according to the invention with one single chord plate.

Expansion-gap bridging device 1 illustrated in FIGS. 5 and 6 has no chord plates (FIG. 5) or one single chord plate 11 (FIG. 6). Bracing profiles 18 and filler profile 32 of overload-safety device 17 are braced on crossbeams 5. In expansion-gap bridging device 1 shown in FIG. 5, the two gaps between overload-safety device 17 and the two projections 16 of bridge parts 3 are closed by two sealing strips 12, which of course are not designed to absorb forces, especially in longitudinal direction L of crossbeam 5. In expansion-gap bridging device 1 shown in FIG. 6, the gap between right projection 16 of right bridge part 3 and overload-safety device 17 is closed by a sealing strip 12 with the aforesaid properties. The gap between left projection 16 of left bridge part 3 and overload-safety device 17 is closed by the single chord plate 11 and two sealing strips 12 with the aforesaid properties.

Figure 8:
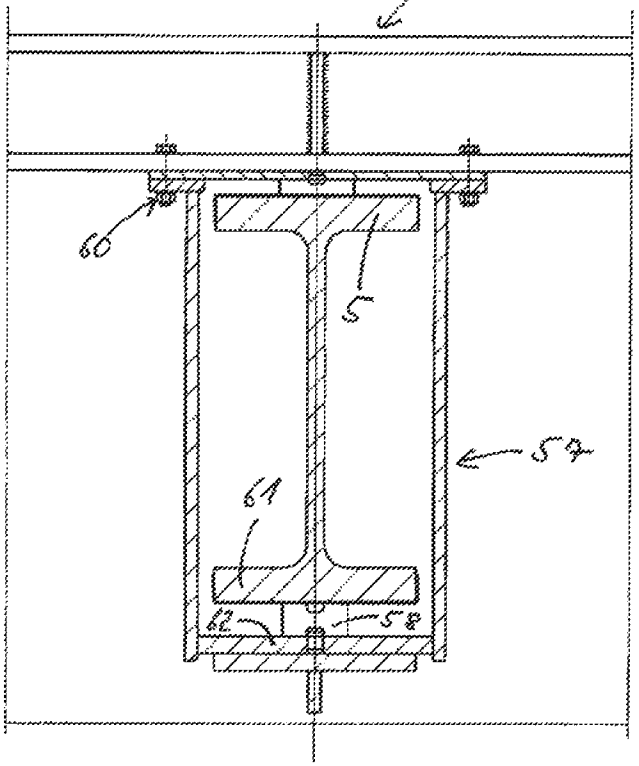
FIG. 8 shows a cross-sectional view of the crossbeam and of the filler-profile bearing according to section C-C through the overload-safety device of FIG. 7.
Figure 7:
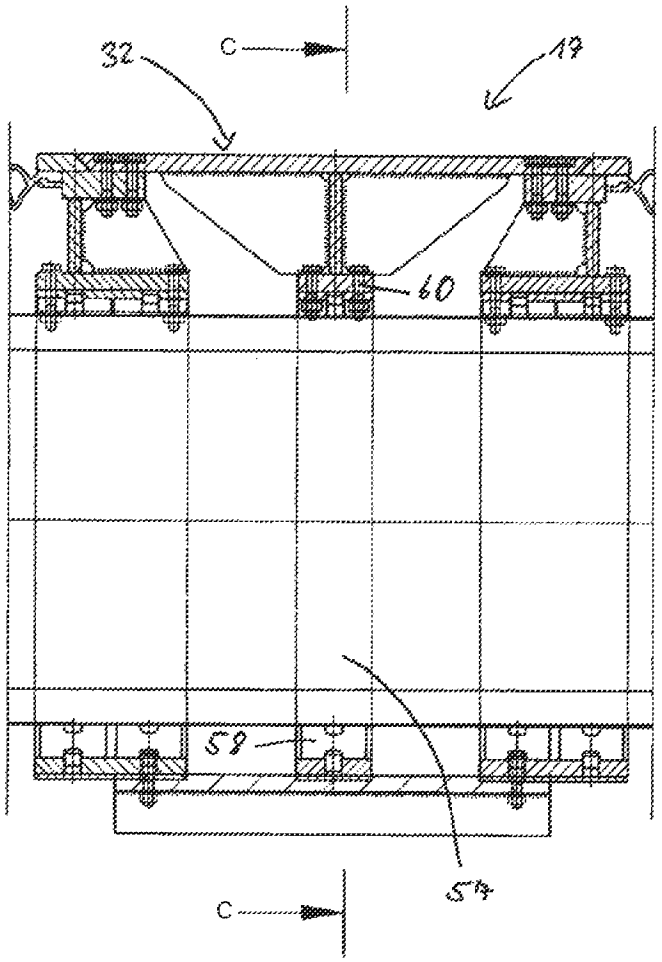
FIG. 7 shows a section parallel to the direction of the crossbeams through an embodiment of an expansion-gap bridging device constructed according to the invention with a frame associated with the filler profile.

FIGS. 7 and 8 show an embodiment of overload-safety device 17 explained in the foregoing with bolted joints 60 functioning as fastening elements with predetermined breaking load on frames 57, which are bolted to filler profile 32 and completely embrace crossbeams 5. Frames 57 of filler profile 32 have the same elements as frames 43 of bracing profiles 18. Sliding spring 58 exerts a spring force on lower crossbeam flange 61 and bottom parts 62 of frame 57, whereby filler profiles 32 are clamped by means of filler profile bearings 41 against crossbeams 5.

What is claimed is:

1. An expansion-gap bridging device (1) in the form of a multi-plate roadway expansion joint (2), which bridges over an expansion gap (4), which is disposed between two structure parts (3) of a traffic-carrying structure, wherein:

the expansion gap (4) is spanned by at least two crossbeams (5), which are braced in load-bearing relationship on two structure parts (3), wherein at least one of the load-bearing bracing points (6) permits a displacement movement of the respective crossbeam (5) relative to the structure part (3) in question;

several chord plates (11) disposed above the crossbeams (5) and oriented at least substantially parallel to one another are braced on the crossbeams (5) in such a way that they can be displaced relative to the crossbeams (5) as well as relative to one another;

an overload-safety device (17) is provided between two of the chord plates (11) that can be displaced relative to the crossbeam (5) as well as relative to one another;

the overload-safety device (17) comprises two bracing profiles (18) spaced apart from one another and braced on the crossbeams (5) as well as one filler profile (32) bridging the gap (S) between the bracing profiles (18);

at least one fixation device (31, 49) that clamps the position of the two bracing profiles (18) relative to one another acts between the two bracing profiles;

when the force acting in the sense of approach of the two bracing profiles (18) toward one another exceeds a threshold value, the fixation device (31, 49) acts to release the position clamp in such a way that the two bracing profiles (18) can be moved toward one another while forcing the filler profile (32) upward out of the gap (S).

2. The expansion-gap bridging device (1) of claim 1, wherein the filler profile (32) is part of the fixation device (31).

3. The expansion-gap bridging device (1) of claim 1, wherein the filler profile (32) is joined to the bracing profiles (18) by means of fastening elements (31) with predetermined breaking load.

4. The expansion-gap bridging device (1) of claim 1, wherein the filler profile (32) rests with peripheral regions (59) on bracing regions (29) of the bracing profiles (18).

5. The expansion-gap bridging device (1) of claim 4, wherein a sealing gasket (58) is provided for the peripheral regions (59) of the filler profile (32) on the bracing regions (29) of the bracing profiles (18).

6. The expansion-gap bridging device (1) of claim 1, wherein sliding chamfers (23, 36, 37, 38) are provided on the filler profile (32) or the bracing profiles (18), in order to favor raising of the filler profile (32) when the bracing profiles (18) move toward one another.

7. The expansion-gap bridging device (1) of claim 1, wherein the filler profile (32) rests on the crossbeams (5).

8. The expansion-gap bridging device (1) of claim 7, wherein the filler profile (32) is clamped against the crossbeams (5) by means of fastening elements (31) with predetermined breaking load.

9. The expansion-gap bridging device (1) of claim 7, wherein frames (57) that embrace the crossbeams (5) and are equipped with a sliding spring (58) in order to clamp the filler profile (32) against the crossbeams (5) as well as at least one fastening element (60) with predetermined breaking load are assigned to the filler profile (32).

10. The expansion-gap bridging device (1) of claim 1, wherein the overload-safety device (17) is provided between substantially equally many chord plates (11).

11. The expansion-gap bridging device (1) of claim 1, wherein the bracing profiles (18) or the filler profile (32) have a traffic-carrying surface (13).

12. The expansion-gap bridging device (1) of claim 1, wherein the bracing profiles (18) are sealed against adjacent chord plates (11) by means of deformable sealing strips (12).

13. The expansion-gap bridging device (1) of claim 1, wherein both ends of the crossbeams (5) are braced in load-bearing and displaceable relationship on the structure parts (3).

14. The expansion-gap bridging device (1) of claim 1, wherein the crossbeams (5) project at both ends into crossbeam boxes (10).

15. The expansion-gap bridging device (1) of claim 1, wherein a plurality of functionally equivalent overload-safety devices (17) is provided.

16. The expansion-gap bridging device (1) of claim 1, wherein an anti-lift safeguard (43) acts between the bracing profiles (18) and the crossbeams (5).

17. The expansion-gap bridging device (1) of claim 16, wherein frames (43) that embrace the crossbeams (5) are assigned to the bracing profiles (18).

18. The expansion-gap bridging device (1) of claim 16, wherein spacer elements (48) that are disposed underneath the crossbeams (5) and are joined to the frames (43) by means of fastening elements (49) with predetermined breaking load are provided between the frames (43) of the two bracing profiles (18).

19. The expansion-gap bridging device (1) of claim 16, wherein respectively at least one sliding spring (51) is disposed within the frames (43) for clamping the bracing profiles against the crossbeams.

20. An expansion-gap bridging device (1) in the form of a multi-plate roadway expansion joint (2), which bridges over an expansion gap (4), which is disposed between two structure parts (3) of a traffic-carrying structure, wherein:

the expansion gap (4) is spanned by at least two crossbeams (5), which are braced in load-bearing relationship on two structure parts (3), wherein at least one of the load-bearing bracing points (6) permits a displacement movement of the respective crossbeam (5) relative to the structure part (3) in question;

one chord plate (11) disposed above the crossbeams (5) is braced on the crossbeams (5) in such a way that it can be displaced relative to the crossbeams (5);

one overload-safety device (17), which is not firmly joined to any of the structure parts (3), is provided in a relationship at least substantially parallel to the chord plate (11);

the overload-safety device (17) comprises two bracing profiles (18) spaced apart from one another and braced on the crossbeams (5) as well as one filler profile (32) bridging the gap (S) between the bracing profiles (18);

at least one fixation device (31, 49) that clamps the position of the two bracing profiles (18) relative to one another acts between the two bracing profiles;

when the force acting in the sense of approach of the two bracing profiles (18) toward one another exceeds a threshold value, the fixation device (31, 49) acts to release the position clamp in such a way that the two bracing profiles (18) can be moved toward one another while forcing the filler profile (32) upward out of the gap (S).

21. An expansion-gap bridging device (1) in the form of an overload-safety device (17), which bridges over an expansion gap (4), which is disposed between two structure parts (3) of a traffic-carrying structure, with the following features:

the expansion gap (4) is spanned by at least two crossbeams (5), which are braced in load-bearing relationship on two structure parts (3), wherein at least one of the load-bearing bracing points (6) permits a displacement movement of the respective crossbeam (5) relative to the structure part (3) in question;

the overload-safety device (17), which is not firmly joined to any of the structure parts (3), comprises two bracing profiles (18) spaced apart from one another and braced on the crossbeams (5) as well as one filler profile (32) bridging the gap (S) between the bracing profiles (18);

at least one fixation device (31, 49) that clamps the position of the two bracing profiles (18) relative to one another acts between the two bracing profiles;

when the force acting in the sense of approach of the two bracing profiles (18) toward one another exceeds a threshold value, the fixation device (31, 49) acts to release the position clamp in such a way that the two bracing profiles (18) can be moved toward one another while forcing the filler profile (32) upward out of the gap (S).

* * * * *